United States Patent [19]

Zwicker

[11] 3,943,854

[45] Mar. 16, 1976

[54] EJECTION HEAD WITH ACTIVE ELEMENTS FOR ROCKETS

[75] Inventor: Kurt Zwicker, Porz-Eil, Germany

[73] Assignee: Dynamit Nobel Aktiengesellschaft, Germany

[22] Filed: Apr. 12, 1974

[21] Appl. No.: 460,480

[30] Foreign Application Priority Data

Apr. 12, 1973 Germany ..... 2318307

[52] U.S. Cl. ..... 102/34.4; 102/7.2; 102/37.6; 102/69

[51] Int. Cl.[2] ..... F42B 4/10; F42B 13/50

[58] Field of Search ..... 102/34.4, 35.6, 37.6, 69, 102/4, 5, 7.2

[56] References Cited

UNITED STATES PATENTS

| | | | |
|---|---|---|---|
| 1,292,374 | 1/1919 | Richardson | 102/69 |
| 3,276,367 | 10/1966 | Edwards | 102/4 |
| 3,712,229 | 1/1973 | Schock | 102/7.2 |
| 3,857,338 | 12/1974 | Bücklisch | 102/4 |

*Primary Examiner*—Charles T. Jordan
*Attorney, Agent, or Firm*—Craig & Antonelli

[57] ABSTRACT

Ejection head for projectiles, rockets or the like having at least one ejection section including a carrier plate, a plurality of ejection tubes for containing active elements mounted annularly about the carrier plate, a descent controller connected to the carrier plate wherein the tubes are movable from a folded position to a spread-apart position for discharging the active elements contained therein. A locking device is provided for locking the tubes in the folded position and a spreading device is provided for spreading the tubes apart with a pyrotechnical element being provided for generating compressed gas for triggering the locking device to unlock the ejection tubes and causing the spreading device to spread the ejection tube apart.

29 Claims, 6 Drawing Figures

FIG. 1
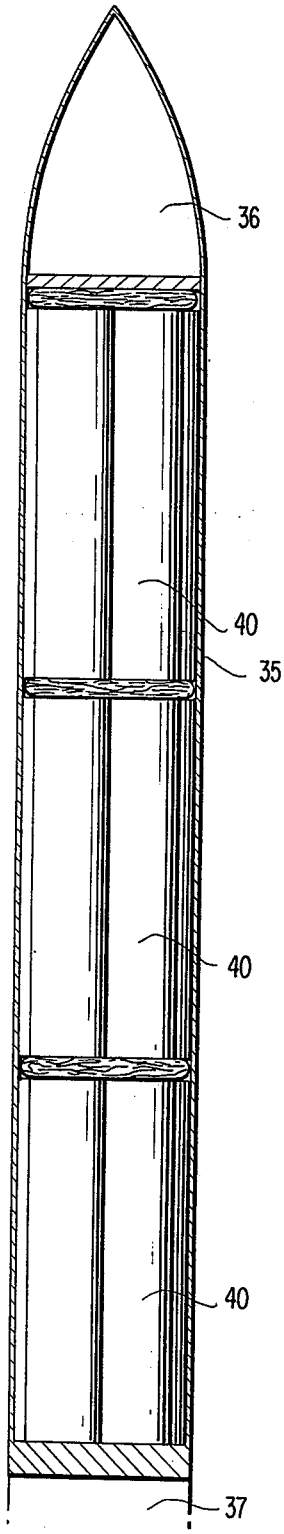
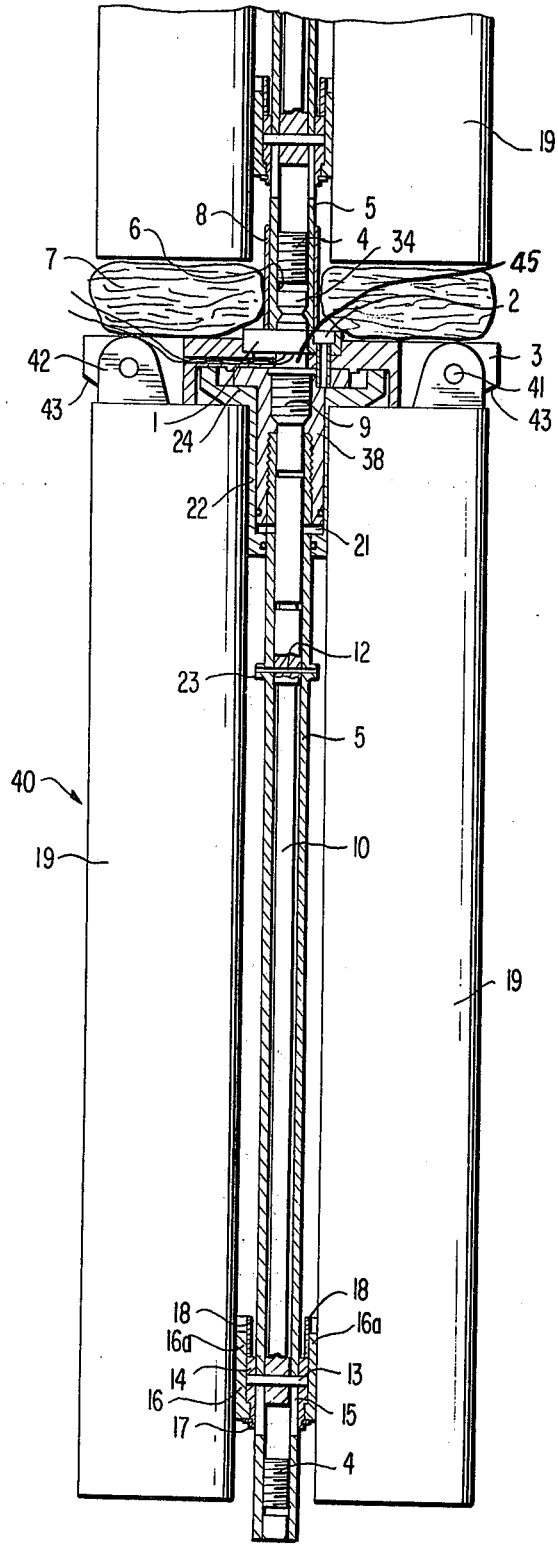
FIG. 2

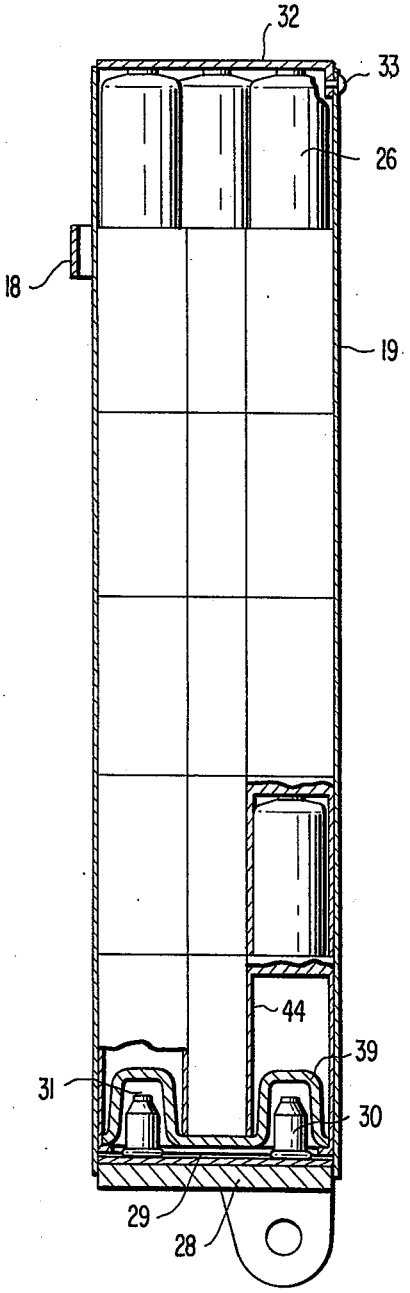
FIG. 4
FIG. 5
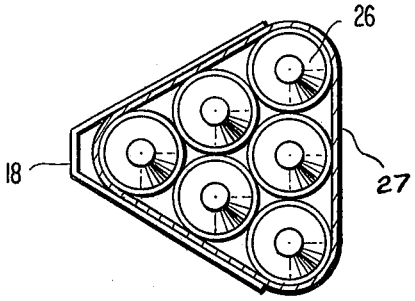
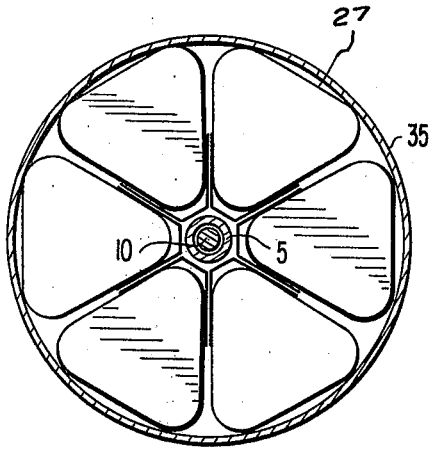
FIG. 6

EJECTION HEAD WITH ACTIVE ELEMENTS FOR ROCKETS

The present invention relates to an ejection head for rockets or the like having ejection tubes annularly mounted on a carrier plate equipped with a parachute, which tubes are arranged to be spread apart by a predetermined angle and contain active elements such as munitions or the like.

Ejection heads have been known wherein the active elements to be ejected are released from only a single tube, by opening the tube during the free fall of the tube, for example by means of pyrotechnical charges, and thus strewing the active element contents around. However, this arrangement has the disadvantage that a nondirectional ejection and thus an uncontrollable distribution of the active elements on the ground occur.

It is also known to accommodate the charge in the shape of active elements directly in a rocket head, without any container, so that, when the rocket case is ejected, the distribution, i.e. release, of the active elements commences immediately. Here again, the distribution of the active elements on the ground is left up to coincidence.

Further, an ejection head for rockets has been proposed wherein several connected ejection tubes in which the active elements to be ejected are housed, are movably arranged on a carrier plate and can be simultaneously spread apart by a predetermined angle. The ejection tubes, in this connection, can be moved by way of hinges, and a limiter ring, mechanically adjustable prior to the firing of the rocket, determines, i.e. limits, the spreading angle of the ejection tubes. Moreover, an additional guidance is provided for the ejection tubes in that tube straps are pushed over the ejection tubes, which straps are slidingly movable and connected with one another by hinges. In such an ejection head, the loading capacity is limited, since the spreading mechanism as well as the guidance of the ejection tubes operate in a purely mechanical manner.

It is an object of the present invention to provide an ejection head for the reception of active elements which provides for the release of the active elements on the ground in definite, repreducible and predeterminable distribution patterns, in addition to affording a large optionally variable loading capacity.

This object is attained by providing an ejection head having a pyrotechnical element which produces compressed gas for triggering an unlocking device and a spreading device for the ejection tubes. By coupling the unlocking with the spreading of the ejection tubes, in accordance with the present invention, a flawless functioning, as well as the obtaining of the desired spreading angle are ensured at any time. Moreover, the spreading device is constructed so that it can be locked in a desired final position, i.e. the spreading position. This is accomplished according to the invention, for example, by arranging, for spreading the ejection tubes, an annular slide member which is centrally disposed in the zone between the carrier plate and the ends of the ejection tubes pivotably attached thereto, which slide member is controlled by means of the pyrotechnical element which produces compressed gas. The unlocking device is constructed, in accordance with the invention, so that the ejection tubes are arranged about an axially extending central holding pipe having a thrust rod guided in the interior thereof and being movable by the compressed-gas-producing pyrotechnical element. The ejection tubes are locked by a sleeve member displaceable by the thrust rod and arranged on the holding pipe, which sleeve member is equipped with claws or extension portions engaging the ejection tubes. It is also possible to accomplish the locking action by other members which engage the ejection tube and/or the end of the ejection tube at the front face. Thus, when the pyrotechnical element which produces compressed gas is ignited, the thrust rod is displaced, on the one hand, according to this invention, whereby the sleeve member retaining the ejection tubes is released, and, on the other hand, the slide member and thus the ejection tubes are thereby moved into their angular position.

In accordance with a further feature of the invention, the carrier plate is equipped with ejection tubes arranged in multiples in axial succession with these multiples being joined together to obtain separable ejection sections. In this way, it is not only possible to obtain a higher loading capacity, but also to strafe a predetermined target zone at uniform intervals with a higher hitting density.

The ejection sections are separated, for example, by way of a pyrotechnically destructible predetermined rupturing zone which can be activated at a given time after dropping the rocket head casing. The predetermined rupturing zone is formed at the hollow shank, receiving a pyrotechnical charge, of a flange bolt attached with the head surface to the carrier plate and threadedly joined by its shank portion to the holding pipe for the ejection tubes. The flange bolt establishes the mechanical connection between the ejection sections which, after severing, permits the separate ejection of each ejection unit.

In order to attain a maximally high packing density of the active elements in the ejection tubes, a further feature of the invention provides for fashioning the ejection tube, as seen in cross section, as an approximately equilateral triangle with rounded and/or truncated corners. In this way, a relatively closed and densely packed circular ring of active elements can be provided. The ejection of the active elements from the individual ejection tubes is effected, in accordance with a further feature of this invention, for example by arranging at the portion of the ejection tube on the bottom side, which is pivotably attached to the carrier plate, at least one compressed gas generator in a well formed by a sabot. This compressed gas generator is then ignited at the appropriate time. Depending on the configuration of the active elements employed, the compressed gas generator can be disposed eccentrically with respect to the cross section of the ejection tube.

These and further objects, features and advantages of the present invention will become more obvious from the following description when taken in connection with the accompanying drawings which show, for purposes of illustration only, several embodiments in accordance with the present invention, and wherein:

FIG. 1 is a schematic view of a rocket with ejection head;

FIG. 2 shows a longitudinal sectional view of an ejection section;

FIG. 4 shows a partial longitudinal section through an ejection tube;

FIG. 5 shows a cross section through the ejection tube of FIG. 4; and

FIG. 6 shows a cross section through an ejection section of FIG. 2.

Figure 3:
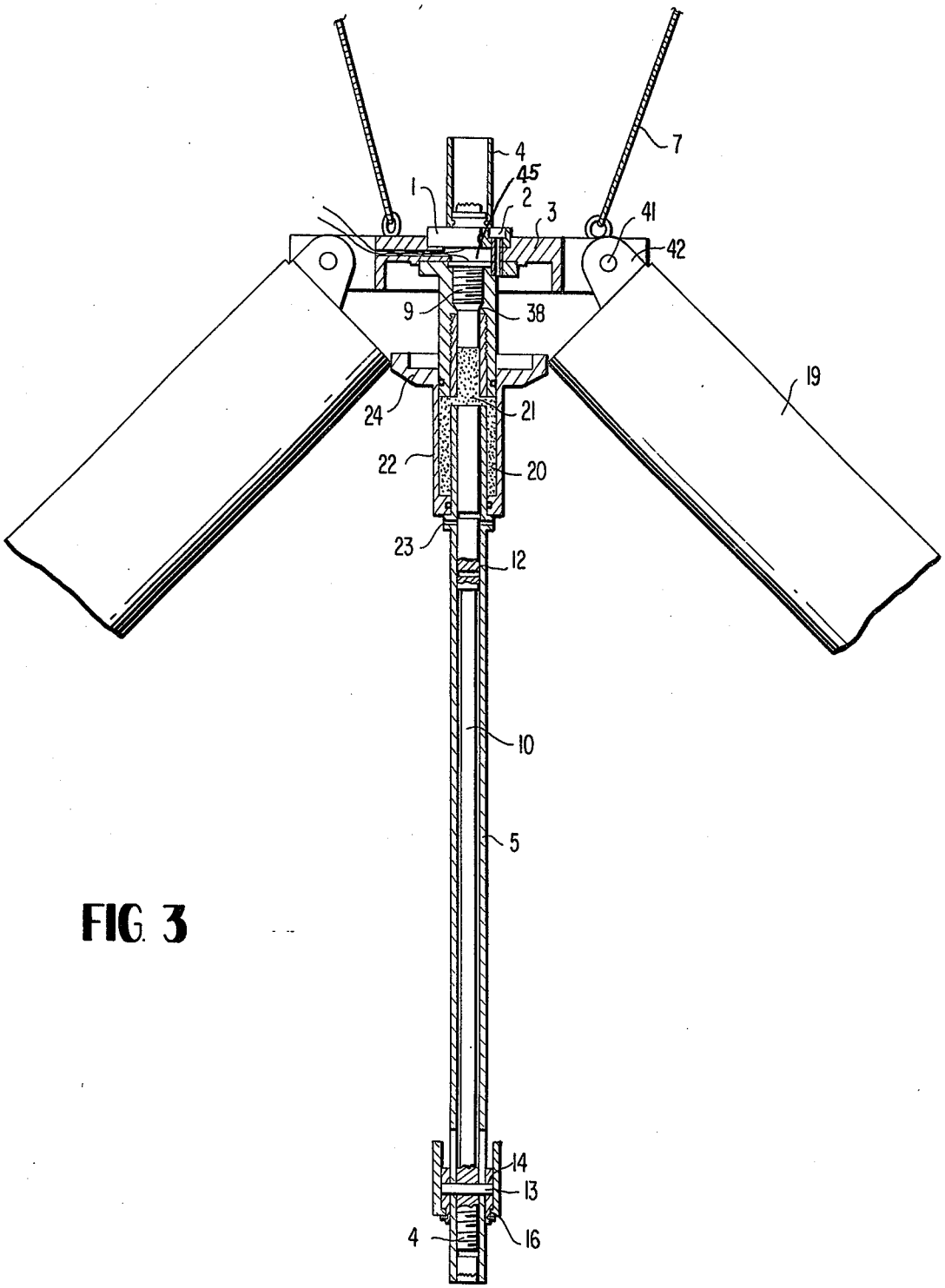
FIG. 3 shows the spreading mechanism of the ejection section of FIG. 2.

Referring now to the drawings wherein like reference numerals are utilized to designate like parts throughout the several views, there is shown schematically in FIG. 1 a projectile such as a rocket having ejection sections 40 housed in a casing 35 and covered at the front end by the tip 36 of the rocket. This part, also called ejection head and/or rocket nose, is joined firmly but separably to the rocket engine 37. After the rocket has been fired, the ejection head of the rocket is released, over a predetermined target zone, by removing the rocket head casing and is separated from the rocket engine, i.e. the remainder of the rocket. In case several ejection sections are provided, these are also separated from one another. A parachute serves for the stabilization of the ejection sections which parachute makes sure that the openings of the ejection tubes of the sections are oriented vertically downwardly. After the ejection sections, stabilized by parachute, are dropping downwardly, the unlocking and spreading devices of the ejection tubes are activated, and the ejection tubes are spread out from a folded position and eject the active elements. The ground area to be strafed is determined, on the one hand, by the spreading angle of the ejection tubes, but, on the other hand, also by the construction of the parachutes. The following figures illustrate in greater detail the construction of the device separating the individual ejection sections from one another or from the remainder of the rocket, as well as the spreading mechanism and the unlocking means of the ejection tubes of one section, and also the packing of the active elements in an ejection tube and the ejection of these elements.

In the ejection section 40 shown in FIG. 2, the ejection tubes 19 are provided in an annular arrangement about a carrier plate 3. At their bottom ends, the ejection tubes have the suspension fork 42 serving to pivotably mount the tubes to the joint pins 41 at the carrier plate 3. The connection of the ejection sections to one another and to the rocket engine is effected by means of a flange bolt 1. The head surface of the flange bolt 1 is joined, via screws 2, with the carrier plate 3 of one of the ejection sections 40 or with the rocket engine. The threaded portion 4 of the hollow flange shank of the flange bolt is threadedly inserted in a holding pipe 5 which is arranged in a centrlaly axial position between the ejection tubes 19 and pertaining to the subsequent ejection section. After the rocket head casing 35 has been removed and the sections 40 are exposed, a charge 34 which is disposed in the shank 4 of the flange is ignited with a time delay via an electronic, mechanical, or pyrotechnical member. The charge 34 is dimensioned so that the expansion of the combustion gases separates the shank of the flange bolt 1 at a predetermined breaking zone 6.

The stabilizing parachute 7 which is attached to the carrier plate 3 is disposed respectively between the individual ejection sections. In order to prevent any hot gas particles or metal particles from damaging the parachute 7 during the separation, an elastic envelope 8 of, for example, polyethylene, surrounds the predetermined breaking zone 6. After the separation of the predetermined breaking zone 6, the head surface with the shank 4, up to the rupturing zone 6, of the flange bolt 1 remains with one ejection section and/or the rocket engine, while the shank portion 4 with the threaded section up to the rupturing zone 6 remains at the other ejection section.

The ejection tubes are unlocked and spread apart as follows: At one end of the centrally guided holding pipe 5, a compressed gas generator 9 is arranged at the carrier plate 3 in a tubular flange member 38 with a spacing 45 from the bolt 1. Up to the instant of ignition of the compressed gas generator 9, the ejection section is in the locked condition. The thrust rod 10 is guided in the holding pipe 5 and bolted together with the latter by a shear pin 12. The thrust rod 10 is disposed directly behind the compressed gas generator 9. At the other end, the thrust rod 10 is joined via a pin 13 to a sliding bushing. The pin 13 is slidingly mounted in the slotted hole 15 of the holding pipe 5. The sleeve 16 is disposed over the sliding bushing 14 and fixed in position by a shoulder. In the other direction, the sleeve 16 is secured axially by the retaining ring 17 seated in a corresponding groove of the sliding bushing 14. The sleeve 16 has an extension portion 16*a* which may be claw members on its end face, each of these extension portions engaging an eye portion 18 of the ejection tubes 19 so as to retain the tubes in the folded position.

After the ejection sections have been separated and stabilized by the parachute 7, i.e. after the ejection tubes 19 have been oriented downwardly with their openings and the section has been stabilized in that its pendulating movement has ceased to a certain extent, the compressed gas generator 9 is ignited, for example electrically by means of a timing member. The thus-liberated gas causes movement of the thust rod 10 so as to shear the shear pin 12 and presses the thrust rod 10 into contact with the threaded portion 4 of the sheared-off flange bolt 1 which has remained in the holding pipe 5. By the axial movement of the thrust rod 10, the sliding bushing 14 is entrained via the pin 13, which bushing, in turn, presses the sleeve 16 downwardly to such a degree that its extension of claw portions 16*a* slide out of the eyes 18 of the ejection tubes 19. The compressed gas which expands in the stagnation space 20 behind the gas generator 9 flows through the bores 21 of the holding pipe 5 and presses a slide member 22 against an abutment 23 at the holding pipe 5. A disk 24, forming part of the slide member 22, presses against the bottom of the ejection tubes 19 and places the latter into the spread-apart position predetermined by the angular surfaces of the hinge arms 43 of the carrier plate 3. Due to the fact that the edge of the bottom of the ejection tubes 19 slides over the annular rim of the axially displaced slide disk 24 and, when the slide member 22 contacts the abutment 23, rests thereon, the ejection tubes 19 are arrested in their angular position. The slide member 22, in turn, can no longer slide back into its initial position, since the gas pressure is preserved in the gas stagnation space 20 of the slide member 22. The use of compressed gas generators 9 makes it possible to prevent damage to the ejection tubes 19 or at the joints, by the relatively gradually effective expansion of the gas. Thereafter, the active elements are ejected from the tubes 19.

In order to attain a high packing density of active elements 26 in the ejection head, the ejection tubes 19 are fashioned as tubes 27 having a triangular contour with rounded and/or truncated corners as shown in FIGS. 5 and 6.

As shown in FIG. 4, in the portion 28 of the ejection tubes on the bottom side, a sabot 29 is disposed which is sealed with respect to the tube wall. The sabot 29 has one or two wells 39 engaging into sleeves 44 of one or two active elements 26 resting on the sabot 29 and respectively, one compressed gas generator 30 is disposed in the wells. The wells are preferably arranged eccentrically with respect to the cross section of the ejection tube. An exactly dimensioned free space 31 is provided between the compressed gas generators 30 and the bottom side of the sabot which space is formed from the spacing of the sabot bottom and the ejection tube bottom, as well as from the zone around the compressed gas generators 30 in the sabot wells. A mounting disk 32 is provided at the ejection opening of the ejection tube 19 which disk is attached to the walls of the ejection tube by means of shear elements 33. If the compressed gas generator or generators 30 are ignited, a pressure is built up in the space 31, which pushes the sabot 29 and thus the active elements 26 out of the ejection tubes 19, while overcoming the shearing force of the shearing elements 33 by means of which the mounting disk 32 is attached. It is also possible to couple the cover at the front end of the ejection tubes with the release of the ejection tubes, so that, when the latter are unlocked and spread apart, the ejection tubes are also opened.

It is noted that the manner of stacking ejection sections with parachutes and utilizing the parachute for stabilization and control of descent after the ejection sections have been separated is disclosed in copending, commonly assigned application, Ser. No. 300,226 filed Oct. 24, 1972, now U.S. Pat. No. 3,857,338.

Obviously, many modifications and variations of the present invention are possible in the light of the above teachings. It should therefore be understood that within the scope of the appended claims, the invention may be practiced otherwise than as specifically described.

I claim:

1. Ejection head of projectiles, rockets and the like, comprising at least one ejection section including a carrier plate, a plurality of ejection tubes for containing active elements mounted annularly about the carrier plate, means for controlling the descent of the ejection section connected to the carrier plate, the ejection tubes being movable from a folded position to a spread-apart position, means for locking the ejection tubes in the folded position, means for spreading the ejection tubes apart, and pyrotecnical element means for generating compressed gas for triggering the locking means to unlock the ejection tubes and for causing the spreading means to spread the ejection tubes apart.

2. Ejection head according to claim 1, wherein the means for controlling the descent of the ejection section includes a parachute.

3. Ejection head according to claim 1, wherein the ejection tubes have one end thereof connected to the carrier plate and the spreading means includes an annular slide member disposed centrally in the zone between the carrier plate and the ends of the ejection tubes pivotally connected thereto, the slide member being movable in response to the generated compressed gas for pivoting the ejection tubes with respect to the carrier plate.

4. Ejection head according to claim 1, wherein the carrier plate is provided with a central holding pipe extending in the axial direction, the ejection tubes being disposed annularly about the holding pipe, the holding pipe being provided with a thrust rod guided in the interior thereof and movable in response to the generated compressed gas.

5. Ejection head according to claim 4, wherein the locking means includes a sleeve slidably mounted on the holding pipe, the sleeve being provided with engagement means for engaging ejection tubes of the ejection section, the sleeve being displaceable in response to the movement of the thrust rod for moving the engagement means out of engagement with the ejection tubes.

6. Ejection head according to claim 5, wherein the spreading means includes an annular slide member having an annular disk portion and a tubular portion extending therefrom, the annular slide member being mounted for sliding movement on the holding pipe and the disk member being positioned for engagement with the ends of the ejection tubes at which the ejection tubes are pivotally connected to the carrier plate, the annular slide member being responsive to the generation of compressed gas for movement with respect to the holding pipe and for simultaneously forcing the ejection tubes outwardly to pivot about the pivotable connection thereof.

7. Ejection head according to claim 6, wherein the carrier plate is provided with annular surface portions for limiting the spread-apart position of the ejection tubes, and the annular slide member in response to the generated compressed gas is retained in a displaced position thereof and in engagement with surface portions of the ejection tubes so as to maintain the ejection tubes in the spread apart position thereof.

8. Ejection head according to claim 7, wherein the carrier plate is provided with a member having a bore therethrough and in communication with the interior of the holding pipe, the pyrotechnical element means being disposed within the bore of the member for supplying compressed gas to the interior of the holding pipe.

9. Ejection head according to claim 5, comprising a plurality of ejection sections, the plurality of ejection sections being interconnected in axial succession and arranged to be separable from one another.

10. Ejection head according to claim 9, comprising means for interconnecting the ejection sections, the interconnecting means being provided with a predetermined rupturing zone for separating adjacent ejection sections from one another.

11. Ejection head acording to claim 10, wherein the interconnecting means includes a flange bolt having its head surface attached to the carrier plate and having its shank portion threadedly connected to the holding pipe, the shank portion having a hollow portion arranged for receiving a pyrotechnical charge, the predetermined rupturing zone being provided at the hollow shank portion and being rupturable in response to the ignition of the pyrotechnical charge.

12. Ejection head according to claim 11, further comprising elastic envelope means surrounding the shank portion of the flange bolt.

13. Ejection head according to claim 11, wherein the holding pipe is arranged to be ruptured at the predetermined rupturing zone of the flange bolt so as to separate the ejection sections from one another.

14. Ejection head according to claim 13, wherein the descent retarding means is disposed between ejection tubes of the adjacent ejection section and an elastic envelope means surrounds the holding pipe in the region of the shank portion of the flange bolt for preventing damage to the descent retarding means during the separation of the ejection sections from one another upon rupturing of the predetermined rupturing zone.

15. Ejection head according to claim 1, wherein each ejection tube of an ejection section has an approximately equilateral triangular cross-sectional shape with at least one of rounded and truncated corners.

16. Ejection head according to claim 1, wherein each ejection tube has a bottom end which is pivotally attached to the carrier plate and a front end, a sabot being provided proximate the bottom end of the ejection tube and forming at least one recess for receiving at least one compressed-gas generator therein.

17. Ejection head according to claim 16, wherein the at least one recess is arranged eccentrically with respect to the cross section of the ejection tube.

18. Ejection head according to claim 17, wherein each ejection tube is provided with a plurality of active elements therein, the active elements being ejected from the ejection tube in response to activation of the at least one compressed gas generator received in the at least one recess of the sabot.

19. Ejection head according to claim 1, wherein each ejection tube has a front end and a bottom end which is pivotally attached to the carrier plate, cover means being provided for closing off the front end of the ejection tube, and shear means being provided for attaching the cover means to the ejection tube.

20. Ejection head according to claim 8, comprising a plurality of ejection sections, the plurality of ejection sections being interconnected in axial succession and arranged to be separable from one another.

21. Ejection head according to claim 20, comprising means for interconnecting the ejection sections, the interconnecting means being provided with a predetermined rupturing zone for separating adjacent ejection sections from one another.

22. Ejection head according to claim 21, wherein the interconnecting means includes a flange bolt having its head surface attached to the carrier plate and having its shank portion threadedly connected to the holding pipe, the shank portion having a hollow portion arranged for receiving a pyrotechnical charge, the predetermined rupturing zone being provided at the hollow shank portion and being rupturable in response to the ignition of the pyrotechnical charge.

23. Ejection head according to claim 22, wherein the holding pipe is arranged to be ruptured at the predetermined rupturing zone of the flange bolt so as to separate the ejection sections from one another.

24. Ejection head according to claim 23, wherein the descent retarding means is disposed between ejection tubes of the adjacent ejection section and an elastic envelope means surrounds the holding pipe in the region of the shank portion of the flange bolt for preventing damage to the descent retarding means during the separation of the ejection sections from one another upon rupturing of the predetermined rupturing zone.

25. Ejection head according to claim 24, wherein each ejection tube has a bottom end which is pivotally attached to the carrier plate and a front end, a sabot being provided proximate the bottom end of the ejection tube and forming at least one recess for receiving at least one compressed gas generator therein.

26. Ejection head according to claim 25, wherein the at least one recess is arranged eccentrically with respect to the cross section of the ejection tube.

27. Ejection head according to claim 26, wherein each ejection tube is provided with a plurality of active elements therein, the active elements being ejected from the ejection tube in response to activation of the at least one compressed gas generator received in the at least one recess of the sabot.

28. Ejection head according to claim 27, further comprising cover means for closing off the front end of the ejection tube, and shear means for attaching the cover means to the ejection tube, the shear means being responsive to the force applied to the cover means by the active elements upon activation of the at least one compressed gas generator received in the at least one recess of the sabot for shearing and releasing the cover means from the ejection tube.

29. Ejection head according to claim 28, wherein each ejection tube of an ejection section has an approximately triangular cross-section shape cross-sectional at least one of rounded and truncated corners.

* * * * *